United States Patent [19]

Lisec

[11] Patent Number: 4,597,279

[45] Date of Patent: Jul. 1, 1986

[54] APPARATUS FOR BENDING HOLLOW SHAPED BAR PORTIONS TO FORM SPACER FRAMES FOR INSULATING GLASS

[76] Inventor: Peter Lisec, Bahnhofstrasse 34, Amstetten-Hausmening, Austria

[21] Appl. No.: 445,832

[22] Filed: Nov. 30, 1982

[30] Foreign Application Priority Data

Jan. 21, 1982 [AT] Austria ..... 216/82
Apr. 5, 1982 [AT] Austria ..... 1354/82

[51] Int. Cl.[4] ..... B21D 7/025; B21D 7/028; B21D 53/74

[52] U.S. Cl. ..... 72/306; 72/384; 72/388; 72/427; 72/446; 72/422

[58] Field of Search ..... 72/387, 388, 384, 305, 72/306, 295, 301, 369, 319–323, 427, 404, 446, 422

[56] References Cited

U.S. PATENT DOCUMENTS

| | | | |
|---|---|---|---|
| 677,933 | 7/1901 | Bright et al. | 72/305 |
| 1,192,797 | 7/1916 | Salmon et al. | 72/320 |
| 1,313,380 | 8/1919 | Henggi | 72/427 |
| 2,285,275 | 6/1942 | Harder . | |
| 2,293,287 | 8/1942 | Franz | 72/427 |
| 2,510,183 | 6/1950 | Luce . | |
| 2,880,560 | 4/1959 | Gibson | 53/389 |
| 2,942,644 | 6/1960 | Beranek | 72/388 |
| 3,438,237 | 4/1969 | Sisler | 72/387 |
| 3,786,666 | 1/1974 | York, Jr. | 72/320 |

FOREIGN PATENT DOCUMENTS

| | | | |
|---|---|---|---|
| 360311 | 1/1981 | Austria . | |
| 54251 | 9/1981 | European Pat. Off. . | |
| 1074948 | 2/1960 | Fed. Rep. of Germany | 72/306 |
| 2128717 | 8/1973 | Fed. Rep. of Germany . | |
| 428949 | 9/1911 | France | 72/388 |
| 608143 | 7/1926 | France | 72/409 |
| 573273 | 3/1976 | Switzerland . | |
| 1394772 | 5/1975 | United Kingdom . | |
| 1481712 | 8/1977 | United Kingdom | 72/369 |

*Primary Examiner*—Daniel C. Crane
*Attorney, Agent, or Firm*—Young & Thompson

[57] ABSTRACT

A spacer frame for insulating glass has corners in which the radii of curvature of the inner wall and the outer wall each are of a larger radius than the side portions of the hollow shaped bar portion. The spacer frame may be manufactured in an apparatus provided for that purpose, having two displaceable bending heads, by first simultaneously bending a hollow shaped bar portion twice through 90°, and then further bending it twice through 90° between the corners, wherein, before the operation of bending the corners, the inner wall of the hollow shaped bar portion is curved inwardly and two notches are produced in the outer wall.

5 Claims, 8 Drawing Figures

APPARATUS FOR BENDING HOLLOW SHAPED BAR PORTIONS TO FORM SPACER FRAMES FOR INSULATING GLASS

The invention relates to a spacer frame for insulating glass, comprising rolled or extruded hollow shaped bar portions which are of an integrally continuous construction in the region of one or more corners of the frame.

Besides spacer frames for insulating glass, which are made up from straight hollow spaced bar portions using corner angle members, use is also made of spacer frames wherein the corners are made by bending the hollow shaped bar portions. The known spacer frames which are of an integrally bent construction suffer from two disadvantages. On the one hand, the radius of curvature in the corner region is relatively large so that in particular the inner curve is visible when the insulating glass is installed, and that is an unattractive aspect. A further disadvantage is that the known corners which are produced by bending hollow shaped bar portions are weakened so that the frames bend when they are subjected to further working or processing—coating them with sealant or adhesive and fitting the spacer frame to a pane of glass in manufacture of insulating glass, such bending phenomena occurring primarily in the corner region. Spacer frames which are made up from straight shaped members do not suffer from the above-indicated advantages of the integrally bent spacer frames, as the corner angle members are stiffer than the frame members themselves.

The invention is based on the problem of providing a corner construction for spacer frames of the general kind set forth above, which does not suffer from the above-mentioned disadvantages.

According to the invention, this is achieved in that the inner wall of the hollow shaped bar portion in the region of the corner is of a larger radius of curvature than the inner corner of the side portions, which are towards the panes of glass, of the hollow shaped bar portion, and that the outer wall in the region of the corner is of a larger radius of curvature than the outer corners of the side portions of the hollow shaped bar portion.

The construction in accordance with the invention provides an extremely small radius of curvature in particular in the region of the inner corner so that, after the insulating glass pane is installed, the spacer frame is not unattractively visible, even when fitted in rabbets of small dimensions. In addition, the combination of different radii of curvature in accordance with the invention provides an extremely high level of rigidity in the corner region of the frames according to the invention.

The invention further provides a method of manufacturing the corner structure in accordance with the invention for spacer frames, wherein operation is advantageous such that the inner wall of the hollow shaped bar portion is deformed inwardly in a trough-like configuration in the region of the corner to be formed, and that the hollow shaped bar portion is then bent around symmetrically with respect to the previously produced trough-like depression, wherein the side walls of the hollow shaped bar portion are kept substantially parallel.

A substantial advantage of the method according to the invention is that not only is it possible for inner corners to be produced, with very small radii of curvature, but in addition the tendency of the side portions of the shaped spacer tube member to deviate from their parallel condition in the bending operation is considerably less than previously. The effect of this fact is that extremely low forces are required to guide the side portions of the spacer shaped tube member in the bending operation, and the result of that is in turn that there is less friction. That fact also contributes to the possibility of producing a corner structure with an extremely small radius of curvature, in particular in the region of the inner corner.

The invention also relates to a method of bending hollow shaped bar portions to form spacer frames for insulating glass assemblies.

Various forms of such methods are known. For example, DOS No. 21 28 717 describes a method wherein metal hollow shaped bar portions are bent to form a spacer frame simultaneously with their being fixed to a pane of glass. In that method, the mode of operation is that the hollow shaped bar portion is bent four times in succession, for which purpose it is conveyed with a stepwise movement in the region of a bend location. Another method is disclosed in Austrian patent specification No. 360 311 (European laid-open specification No 0 009 703), in which the four corners of the spacer frame are also bent in succession, for which purpose Austrian patent specification No. 360 311 provides that slots are milled in the inner walls of the hollow shaped bar portions. A common factor in the known methods is that a hollow shaped bar portion is moved with a stepwise motion to a bending location in which the four corners of the spacer frame are formed in successive bending operations, with the hollow shaped bar portion being advanced by a predetermined amount between the individual bending operations. The result of this mode of operation is that it is not only necessary for a portion of given length to be cut off hollow shaped bar portions, but in addition the hollow shaped bar portion must be advanced four times, by a precisely predetermined amount.

The invention is therefore also based on the problem of providing a bending method of the general kind set forth above, whereby hollow shaped bar portions can be bent more quickly than hitherto and at lower cost, to form insulating glass spacer frames.

According to the invention, this is achieved in that the hollow shaped bar portions is bent twice through 90° in each case and that thereupon the resulting U-shaped hollow spaced bar portion is bent again twice through 90°, between the first bend locations.

With the bending method according to the invention, it is no longer necessary for the position of the hollow shaped bar portion to be changed after the first bending operations so that the alignment operations which that would involve can be omitted. In addition, it is a matter of no import where the first two bend locations occur in the hollow shaped bar portion, as the only important consideration is the spacing of the two bend locations which are formed first. A similar consideration also applies in regard to the second bend locations which should only be arranged symmetrically with respect to the centre of the section of the hollow shaped bar portion which is disposed between the first two bend locations.

A further saving of time is achieved if the two first bending operations are first carried out simultaneously, followed then by the two second bending operations which are also carried out simultaneously.

An advantageous apparatus for carrying out the method according to the invention is characterised in that a holder for the hollow shaped bar portion to be bent is provided at the edge of a plate, and two bending heads which are arranged displaceably along the edge of the plate are provided for carrying out the bending operation.

Further details and features of the invention will be apparent from the subsidiary claims and the following description with reference to the drawings in which:

Figure 1:
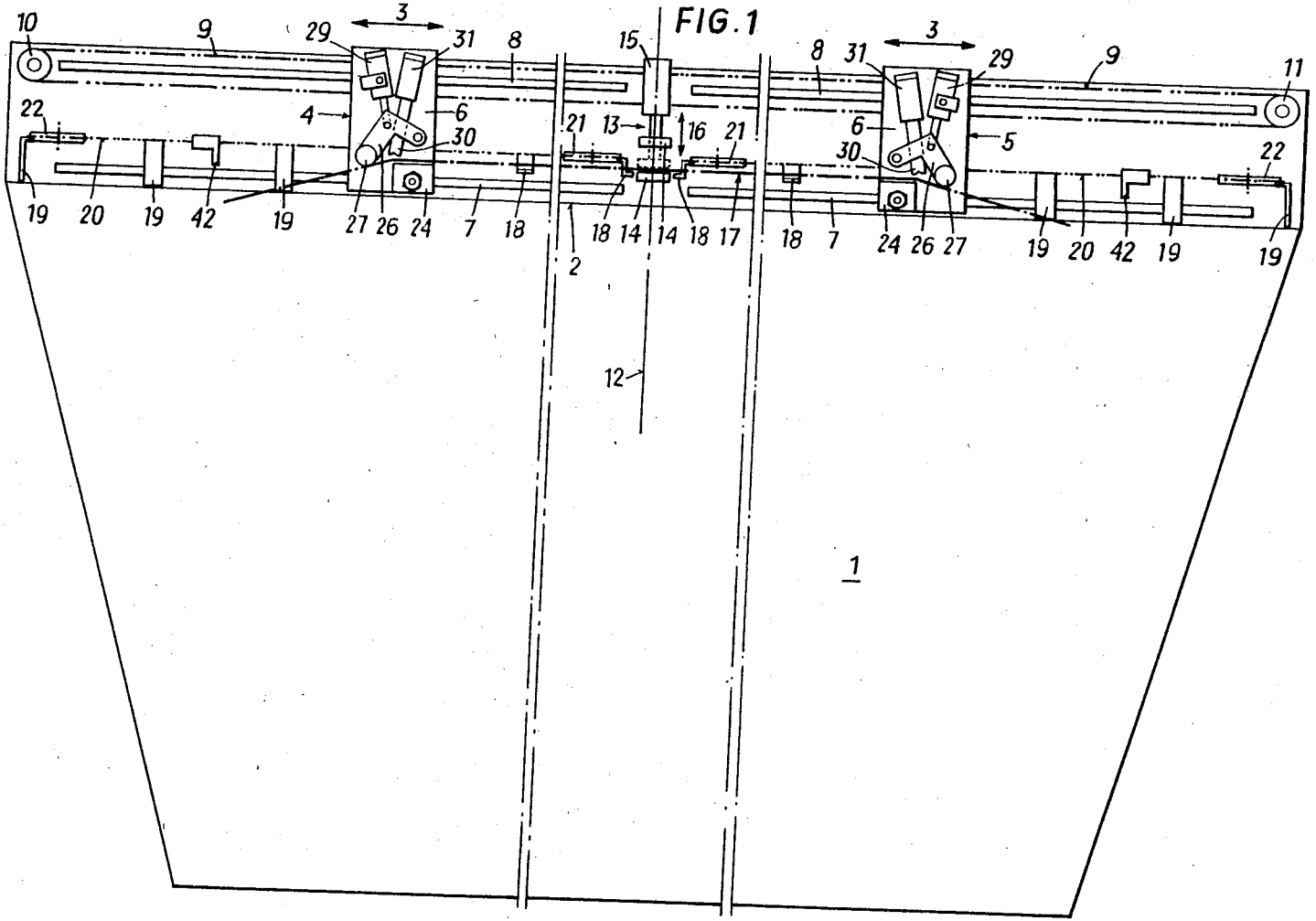
FIG. 1 shows a plan view of a bending apparatus.

The apparatus shown in principle in FIG. 1 comprises a plate 1 which is inclined at an angle of about 10° to 15° relative to the horizontal, with the edge of the plate 1 which is the lower edge in FIG. 1 being lower than the edge which is the upper edge of FIG. 1.

Disposed in the region of the upper edge 2 of the plate 1 are two bending heads 4 and 5 which are displaceable along the edge 2, in the direction indicated by the double-headed arrows 3. The bending heads 4 and 5 each comprise a base plate 6 which is guided slidably on rails 7 and 8 parallel to the upper edge 2 of the plate 1. The arrangement has an endless conveyor chain 9 for moving the two bending heads 4 and 5, the chain 9 passing around direction-changing guide wheels 10 and 11 whose axes are vertical. The bending heads 4 and 5 are secured to different runs of the conveyor chain 9, for example the bending head 4 is secured to the chain run which is towards the plate while the bending head 5 is secured to the run of the chain 9 which is at the top of FIG. 1. That arrangement provides that the bending heads are displaceable with a symmetrical movement over equal distances and in opposite directions, relative to the centre plane 12 of the bending apparatus.

Disposed precisely centrally between the two bending heads 4 and 5 is a stationary clamp arrangement 13 comprising clamping jaws 14 and a pressure fluid cylinder 15 for actuating one of the two clamping jaws in the direction indicated by the double-headed arrow 16. A hollow shaped bar portion 17 which is diagrammatically indicated in FIG. 1 by a dash-dotted line is held in the position shown in broken lines in FIG. 1, so that the hollow shaped bar portion 17 can no longer move in the direction of the long edge 2 of the plate 1.

Hook-shaped angle support members 18 are provided for supporting the hollow shaped bar portion 17 in the region between the bending heads 4 and 5. The support members 18 are provided only in the region between the two bending heads 4 and 5. Disposed in the region outside the two bending heads 4 and 5 are flat guide brackets or loop members 19 which extend with their free ends to the surface of the plate 1. Both the support members 18 and the guide members 19 are secured to endless chains 20 which are coupled to the respectively associated bending head 4 or 5 respectively and which pass over direction-changing guide wheels 21 and 22 which have horizontal axes. As shown in FIG. 1, the support members 18 are secured to each of the two chains 20 in the region between the two bending heads 4 and 5, whereas the guide members 19 are secured to the chains in the region outside the two bending heads. As the chains 20 are coupled to the bending heads 4 and 5 respectively, when the bending heads 4 and 5 are displaced outwardly further support members 18 which are secured to the chains 20 gradually move outwardly in the region between the two bending heads 4 and 5, and there serve as support means for a hollow shaped bar portion 17 which is fitted into the bending apparatus. If on the other hand the bending heads 4 and 5 are moved towards each other, additional guide members 19 are moved upwardly by the chains 20 so that the sections of the hollow shaped bar portion 17 which are outside the bending heads are securely guided on the surface of the plate 1 when the bending operation is carried out.

Figure 2:
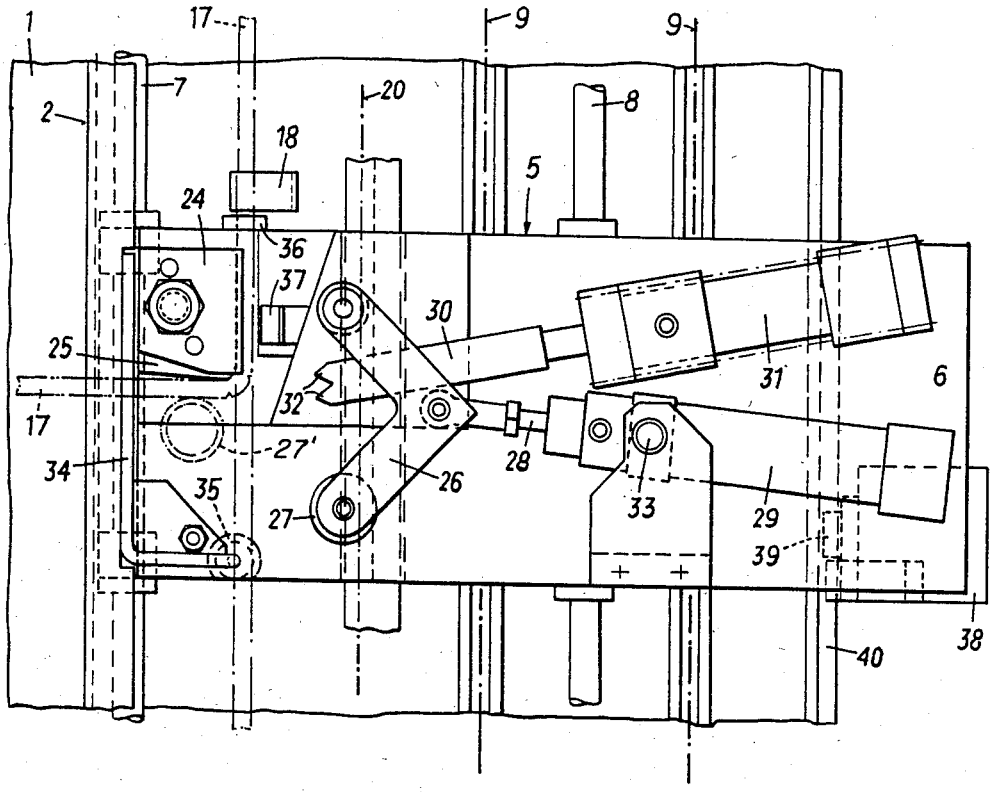
FIG. 2 shows a plan view of one of the bending heads of the apparatus shown in FIG. 1.
Figure 3:
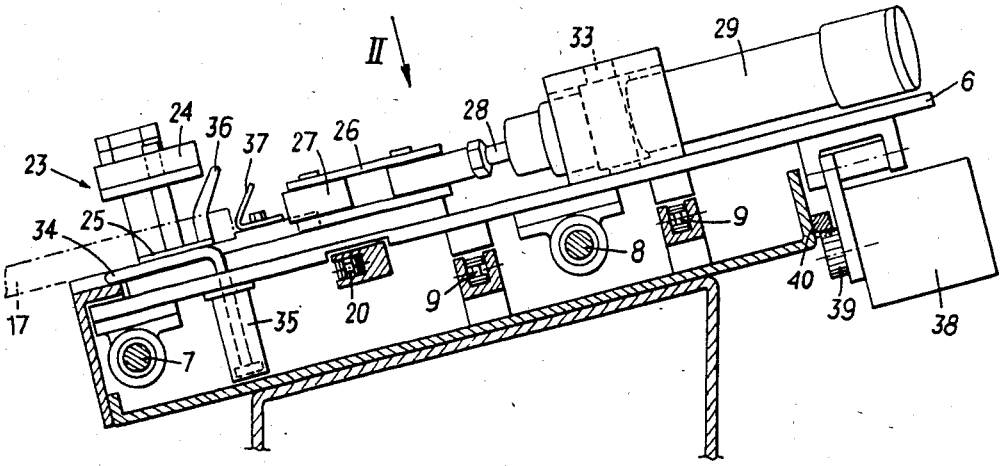
FIG. 3 shows a side view of the bending head shown in FIG. 2, FIGS. 4*a*–4*c* show different phases in the operation of bending hollow shaped bar portions.

As shown in FIGS. 2 and 3, the arrangement includes guide jaws 23, wherein the upper jaw is formed as a holddown means 24 and can be moved downwardly by a drive (not shown) so that a hollow shaped bar portion 17 is guided between the two jaws 24 and 25 while the bending operation is being performed. To carry out the bending operation, an elbow lever 26 is mounted pivotally on the base plate 6, the elbow lever 26 carrying a pressure roller 27 at its free end while the piston rod 28 of a pressure fluid cylinder 29 engages the elbow bent portion of the lever 26. Actuation of the cylinder 29 can cause the pressure roller 27 to be moved forward into the position 27′ shown in broken lines in FIG. 2, so that the hollow shaped bar portion 17 which is guided by the guide jaws 23 is bent, as can be seen from FIG. 2. When this bending operation is being performed, the guide jaws 23 serve at the same time as a bending support means.

Also provided on the base plate 6 is a pressing punch or stamp 30 which can be actuated by a pressure fluid cylinder 31. At its front end, the punch 30 carries two prongs 32 with which the wall 54, which is towards the two prongs, of the hollow shaped bar portion 17, that is to say, the wall 54 which is the outer wall in the spacer frame when the frame is in its finished bent condition, can be notched or pressed in.

The pressure fluid cylinder 31 for the punch 30 is fixedly mounted on the base plate 6, whereas the pressure fluid cylinder 29 for actuating the pressure roller 27 is mounted on the base plate 6 pivotally about an axis 33.

Also provided on each bending head 4 and 5 is an ejector bar or loop member 34 which can be lifted by means of a pressure fluid cylinder 35 to eject a finished bent spacer frame. As can be seen in particular from FIG. 3, in its rest position the ejector member 34 lies below the hollow shaped bar portion 17 which has been bent to form the spacer frame so that, when the ejector member 34 is raised, it also raises the frame. So that the limb of the spacer frame, which extends parallel to the edge 2 of the plate 1, does not foul against the holddown jaw 24 in the ejection operation, the arrangement includes a deflector 36 which is secured for example to the lower guide jaw 25. As soon as the frame has been lifted over the guide jaws 23 by the ejector member 34, it slips downwardly on the plate 1 because of the angle of inclination thereof, and can then be removed therefrom for further treatment.

FIG. 3 also shows that a guide plate 37 is mounted in the region of the guide jaws 23, to facilitate correctly fitting a hollow shaped bar portion into the arrangement in the region of the bending heads 4 and 5.

Figure 4A:
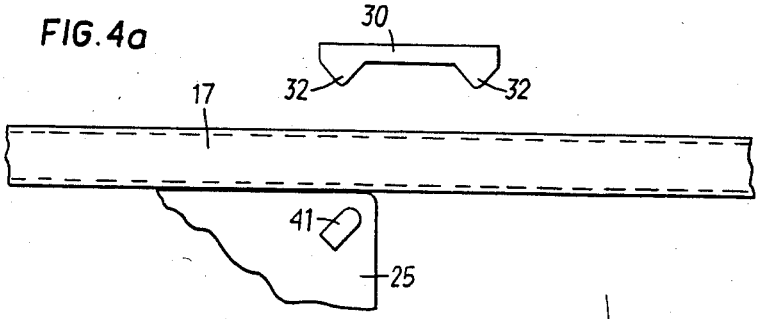
Figure 4B:
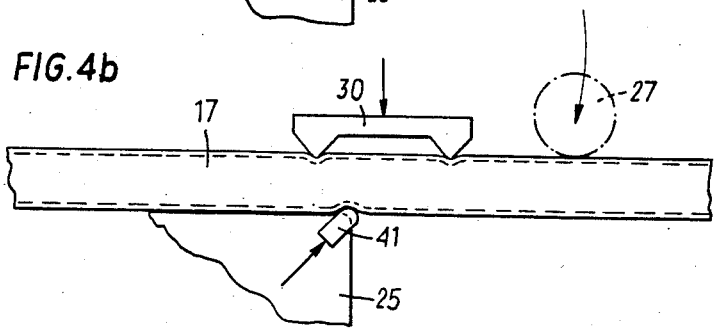
Figure 4C:
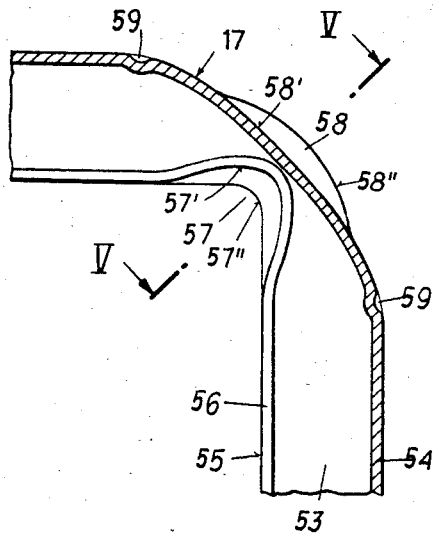
Figure 5:
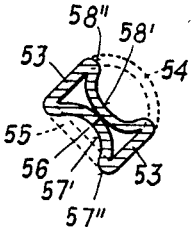
FIG. 5 shows a view in section through a bend location taken along line V—V in FIG. 4*c*.

The mode of operation of the apparatus described above is as follows:

A hollow shaped bar portion 17 of a length corresponding to the periphery of the spacer frame 51 to be produced is fitted into the apparatus in such a way that it is arranged between the jaws of the clamping jaw 13 and lies on the angle support members 18 in the region between the two bending heads 4 and 5. After the clamping jaw 13 has been closed and the bending heads 4 and 5 have been positioned in the region of the bend locations A which are to be produced first (for this purpose, the bending heads are provided thereon with travel measuring means 38 which engage for example by way of gears 39 into toothed racks 40 and thus detect the respective position or travel movement of the bending heads 4 and 5), the two first bending operations are carried out. For that purpose, the pressing punch 30 is first moved forward so that, as can be seen from FIG. 4*b*, notches 59 are produced in the outer wall 54 of the bar portion 17, or the outer wall is curved inwardly somewhat. At the same time as the pressing punch 30 is moved forward, a punch 41 which is provided in the region of the guide jaws 23 can also be moved forward (FIGS. 4*a* and 4*b*), to produce an inward curvature in the wall 55 of the hollow shaped bar portion 17, which is the inner wall in the finished spacer frame (the punch 41 is not shown in FIGS. 2 and 3 for the sake of clarity). By actuating the pressure fluid cylinder 29, the hollow shaped bar portion 17 is then bent, thereby producing a corner structure as shown in FIGS. 4*c* and 5.

After the above-described bending operations have been carried out, the pressure rollers 27 are retracted again and, after the guide jaws 23 are released, the bending heads 4 and 5 are moved towards each other until they are in the appropriate position for the second bending operations to be performed (corners B). The second bending operations are carried out in the same manner as the first two bending operations and also at the same time.

By virtue of the second bending operations, the hollow shaped bar portion 17 which is of a substantially U-shaped bent configuration after the first bending operations have been carried out is bent into the form of a finished spacer frame 51, with the free ends of the hollow bar portion 17 being in contact with each other (butt location 52').

Actuation of the ejector member 34 causes the finished bent spacer frame 51 to be lifted out of the bending heads 4 and 5 and out of the clamp jaw 13 which has been released in the meantime, and the spacer frame now slides down along the plate 1.

The distance between the first two bend locations (A), and thus also the operative distance between the bending support means (guide jaws 23) corresponds to the sum of the lengths b of the two limbs, which are perpendicular to the edge 2 of the plate 1, of the finished frame, and the length a of the limb of the frame which is received in the clamping jaw 13. As the length of the hollow shaped bar portion corresponds to the periphery of the spacer frame 51 and as the distance between the first bend locations (A) is as described above, the sum of the lengths of the two parts which are bent over after the first bending operations is equal to the length a of the limb of the frame which extends parallel to the edge 2.

In the second bending operations (B), the operative spacing of the bending support means and thus of the two bend locations (B) corresponds to the length a of the limb of the frame which extends parallel to the edge 2. Therefore, irrespective of whether the hollow shaped bar portion 17 is aligned symmetrically with respect to the clamping jaw 13 or the centre plane 12 of the apparatus, the result produced is a closed frame 51, if the above-described conditions are observed.

If it is desired that the butt join region 52' of the frame 51 is to be in the middle of the respective limb of the frame, the hollow shaped bar portion 17 will be fitted into the arrangement in such a way that the clamping jaw 13 which is in the middle between the bending heads 4 and 5 engages the hollow shaped bar portion 17 in the centre thereof. Fitting the shaped bar portion 17 in the apparatus in a symmetrical position as referred to above can be facilitated by adjustable abutment members 42 being provided outside the bending heads. The spacing between the abutment members 42 is so set that it corresponds in each situation to the length of the hollow shaped bar portion 17 and thus the periphery of the respective frame 51 to be produced. Abutment members 42 of that kind also have the advantage that it is possible to ascertain at any time whether the hollow shaped bar portion 17 which is fitted into the apparatus is of the correct length.

The present invention provides an apparatus which can be used to produce a spacer frame from one piece of material, wherein in particular by virtue of using the punches 30 and 41, the radii of bending are small and the frames are of such an angular design that the spacer frames produced in the above-described manner scarcely differ from a frame with welded corners or inserted corner members, so that the construction of a window in which insulating glass components with the spacer frame produced using the apparatus according to the invention are installed is not adversely affected.

In contrast, the known bent frames have very large radii of bending so that the known spacer frames are visible in the window, particularly in the corners thereof, and thus detrimentally affect the construction and appearance of the window.

Figure 6:
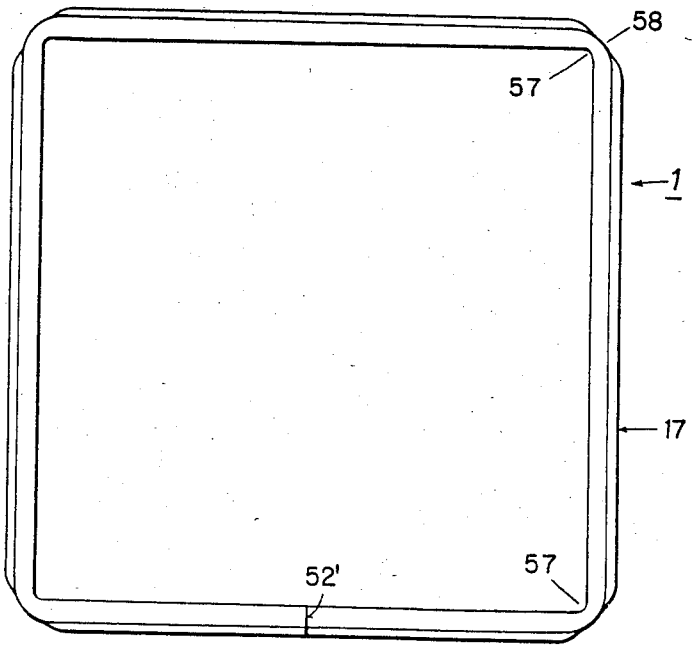
FIG. 6 shows a spacer frame.

By virtue of the particular corner configuration of the frame 1 shown in FIG. 6, which comprises a single hollow shaped bar portion 17 and the butt join 52' of which is held together by an inserted connector member (not shown), the spacer frame designed in accordance with the invention does not have any unattractively visible corners. This corner configuration is described in greater detail hereinafter with reference to FIGS. 4*c*, 5 and 6.

The hollow shaped bar portion 17 which for example is used comprises two side portions 53 which extend parallel to each other and which face towards the panes of glass, in the insulating glass assembly. The side portions 53 are connected together by way of an inner wall 55 and an outer wall 54, with a longitudinal seam 56 being disposed in the region of the inner wall 55, when the hollow shaped bar portions are rolled components. The longitudinal seam 56 may be of any configuration. Thus, stepped fold-type longitudinal seams are just as possible as longitudinal seams having means for hooking together the two halves of the inner wall 55.

FIG. 4*c* in particular shows that, in the region of the corner 57, the inner wall 55 forms a corner 57', the radius of curvature of which is larger than that of the inner corner 57'' of the side portions 53.

A similar situation arises in the region of the outer edge of the hollow shaped bar portion 17. In that case, the corner 58' of the outer wall 54 is bent with a larger radius of curvature than the outer corner 58" of the side portions 53.

The above-indicated selection in respect of the radii of curvature in the corner region provides a corner which is extremely resistant to bending. This effect is further increased if the radius of curvature of the inner wall 55 decreases continuously from a maximum in the region of the longitudinal centre plane of the hollow shaped portion 17 (radius of the curvature in the region of the inner corner 57'), to the radius of curvature of the inner corner 57" of the side portions. The same effect is produced by the configuration of the outer corner wherein the radius of curvature of the outer surface 54 decreases continuously from a maximum in the region of the longitudinal centre plane of the portion 17 (curvature in the region of the outer corner 58') to the radius of curvature of the outer corners 58" of the side portions 53 of the bar portion 17.

The essential steps in manufacturing such a corner construction are as follows:

First of all, the inner wall 55 of the hollow bar portion is pressed inwardly in the region of the corner to be formed, for example by means of the punch 41, so as to form a trough-like or cradle-like depression in the corner region. Then, the hollow shaped bar portion 17 is bent through a right angle in a plane parallel to the planes defined by the side portion 53, the trough or cradle which is previously produced in the inner wall 55 being disposed symmetrically with respect to the corner which is thus formed. In the bending operation, the side portions 53 of the hollow shaped bar portion 17 are guided for example by means of the guide jaws 24, while, by virtue of the trough-like depression produced in the inner wall 55 before the bending operation, there is no need for the side portions 53 to be pressed in the bending operation so that there are also no high frictional forces arising between the side portions 53 and the guide tools (guide jaws 24). By virtue of the low level of friction which occurs, the bending operation can be easily performed, and the desired sharp corners are produced.

In order further to facilitate the bending operation, before the hollow shaped bar portion 17 is bent over, notches 59 are formed in the outer wall 54 of the portion 17, on both sides of the trough-like depression in the inner wall 55. The notches 59 can also be produced at the same time as the bending operation is initiated. The notches 59 permit the outer wall 54 more readily to assume the position (corner 58') in accordance with the invention, as shown in FIG. 4*c*. This occurs even when the frame 51 comprises relatively hard alloys (magnesium-aluminum alloys).

I claim:

1. Apparatus for bending hollow shaped bar portions to form spacer frames for insulating glass, comprising a pair of bending heads (4, 5) each having upper and lower guide jaws (24, 25) and means (27) pivotal about an axis so that said means pivots toward a hollow bar portion to bend the same 90° about both pairs of guide jaws to form on said hollow bar portion an intermediate section extending between said bending heads and further bent limb sections that extend from opposite ends of said intermediate section in one direction and parallel to each other, means for holding (14) said intermediate sections and mounted between each bending head (4, 5), an ejector bar member (34) on each bending head (4, 5) in such a position that the ejector bar member (34) is adapted to engage the bent limb, means for lifting the ejector bar members (34) parallel to said axis about which said means (27) pivots to engage said bent limb of the frame for raising the bent hollow shaped bar portions (17), and a deflector member (36) on the lower guide jaw (25), said deflector member (36) deflecting the frame in a direction opposite said one direction past the upper guide jaw (24) and transverse to said axis when the ejector bar members are lifted.

2. Apparatus for bending hollow shaped bar portions to form spacer frames for insulating glass, comprising a pair of bending heads (4, 5) each having upper and lower guide jaws (24, 25) and pivotal means for bending said bar relative to said guide jaws, an ejector bar member (34) on each bending head (4, 5), means for lifting the ejector bar members (34) to engage a bent limb of the frame for raising the bent hollow shaped bar portions (17), a deflector member (36) on the lower guide jaw (25), said deflector member (36) deflecting the frame past the upper guide jaw (24) when the ejector bar members are lifted, and a holder (13, 18) for the hollow shaped bar portion (17) intermediate said pair of bending heads and provided at the edge of a plate (1), said two bending heads (4, 5) being arranged displaceably along the edge (2) of the plate (1), each of said bending heads (4, 5) comprising a pressing punch (30) having two prongs (32) for pressing notches (59) into the wall (54) of the hollow shaped bar portion (17).

3. Apparatus as claimed in claim 2, in which said pressing punch presses the hollow shaped bar portion about said guide jaws, said two prongs being disposed on opposite sides of said guide jaws during bending of the hollow shaped bar portion.

4. Apparatus as claimed in claim 2, and an endless chain (20) associated with each said bending head (4, 5), and support members (18) for a said hollow shaped bar portion (17), said support members being secured to the endless chains and the endless chains being coupled to the respectively associated bending heads (4, 5) to move the bending heads simultaneously in opposite directions.

5. Apparatus for bending hollow shaped bar portions to form spacer frames for insulating glass, comprising a pair of bending heads (4, 5) having upper and lower guide jaws (24, 25) an ejector bar member (34) on each bending head (4, 5), means for lifting the ejector bar members (34) to engage a bent limb of the frame for raising the bent hollow shaped bar portions (17), a deflector member (36) on the lower guide jaw (25), said deflector member (36) deflecting the frame past the upper guide jaw (24) when the ejector bar members are lifted, said bending heads (4, 5) being secured to oppositely moving runs of the same endless conveyor chain (9) in order to be displaceable in opposite directions over the same distances symmetrically on opposite sides of a clamping jaw (13) by which a midportion of said hollow shaped bar portion is gripped, said bending heads being secured at their one end to said same endless conveyor chain and at their other ends each to a separate one of second and third conveyor chains, said second and third chains each having support members for supporting said hollow shaped bar, means for driving said second and third conveyor chains in opposite directions from each other, said second and third conveyor chains being disposed in a plane transverse to the plane in which the first mentioned conveyor chain is disposed such that axes about which the second and third conveyor chains move are transverse to the axis about which the first conveyor chain moves, thereby simultaneously to move both ends of each bending head.

* * * * *